US010465306B2

(12) United States Patent
Yi et al.

(10) Patent No.: US 10,465,306 B2
(45) Date of Patent: Nov. 5, 2019

(54) METHOD FOR PREPARING TITANIUM BY USING ELECTROWINNING

(71) Applicant: SNU R&DB FOUNDATION, Gwanak-gu, Seoul (KR)

(72) Inventors: Kyung-Woo Yi, Gwanak-gu (KR); Jong-Ha Park, Gwanak-gu (KR); Ho-Gil Choi, Gwanak-gu (KR)

(73) Assignee: SNU R&DB FOUNDATION, Seoul (KR)

( * ) Notice: Subject to any disclaimer, the term of this patent is extended or adjusted under 35 U.S.C. 154(b) by 85 days.

(21) Appl. No.: 15/504,640

(22) PCT Filed: Jul. 31, 2015

(86) PCT No.: PCT/KR2015/008062
§ 371 (c)(1),
(2) Date: Feb. 16, 2017

(87) PCT Pub. No.: WO2016/028009
PCT Pub. Date: Feb. 25, 2016

(65) Prior Publication Data

US 2017/0241029 A1 Aug. 24, 2017

(30) Foreign Application Priority Data

Aug. 20, 2014 (KR) ..... 10-2014-0108369

(51) Int. Cl.
*C25C 3/26* (2006.01)
*C25C 3/00* (2006.01)
(Continued)

(52) U.S. Cl.
CPC ..... *C25C 3/28* (2013.01); *C25C 7/02* (2013.01); *C25C 7/06* (2013.01)

(58) Field of Classification Search
CPC .. C25C 3/28; C25C 7/005; C25C 3/26; C25C 7/025; C25B 1/00
(Continued)

(56) References Cited

U.S. PATENT DOCUMENTS 5,976,345 A * 11/1999 Pal ..... C25C 3/00 204/243.1
2014/0291161 A1* 10/2014 Awazu ..... C25C 3/34 205/348

FOREIGN PATENT DOCUMENTS

CN 1040631 C 11/1998
CN 103088370 * 5/2013 ..... C25C 3/28
(Continued)

OTHER PUBLICATIONS

Chinese Office action for Application No. 201580044635.4, dated Dec. 13, 2017, 9 pages.
(Continued)

*Primary Examiner* — Zulmariam Mendez
(74) *Attorney, Agent, or Firm* — Lewis Roca Rothgerber Christie LLP

(57) ABSTRACT

The present disclosure relates to a method for preparing titanium by using electrowinning and, more specifically, to a method for preparing titanium by using electrowinning, comprising the steps of: preparing a mixture by mixing a solid electrolyte, which contains an oxide of a Group 1 element and boron oxide, with titanium dioxide; and forming a molten oxide from the mixture by putting the mixture in an electrowinning apparatus comprising an anode and an insoluble cathode and heating the same, and then forming titanium on the cathode by applying voltage to the anode and the cathode.

8 Claims, 6 Drawing Sheets

(51) Int. Cl.

| | |
|---|---|
| ***C25C 1/00*** | (2006.01) |
| ***C25C 3/28*** | (2006.01) |
| ***C25C 7/02*** | (2006.01) |
| ***C25C 7/06*** | (2006.01) |

(58) Field of Classification Search
USPC ..... 205/366, 398
See application file for complete search history.

(56) References Cited

FOREIGN PATENT DOCUMENTS

| | | | |
|---|---|---|---|
| CN | 103906861 | A | 7/2014 |
| JP | 6-173065 | | 6/1994 |
| JP | 2001-508130 | A | 6/2001 |
| JP | 2013-147731 | A | 8/2013 |
| WO | WO 98/49357 | A1 | 11/1998 |

OTHER PUBLICATIONS

Hariharan, M. et al.; "Preparation of Titanium Boride in an Arc Furnace"; B. Electrochem; 3(2); Mar.-Apr. 1987; pp. 159-160.
Park, Jong-Il et al.; "A study on the time-dependent behaviors of titanium electro-reduction in molten salts"; J. Kor. Inst. Met & Mater.; vol. 45; No. 10; 2007; pp. 567-572.
Udy, David John; "Aspects of the Chemistry of Titanium Dioxide in Fused Salt Solvents"; A thesis submitted to the University of Auckland for the Degree of Doctor of Philosophy; Jun. 1973; 151 pp.

* cited by examiner

【FIG. 1】
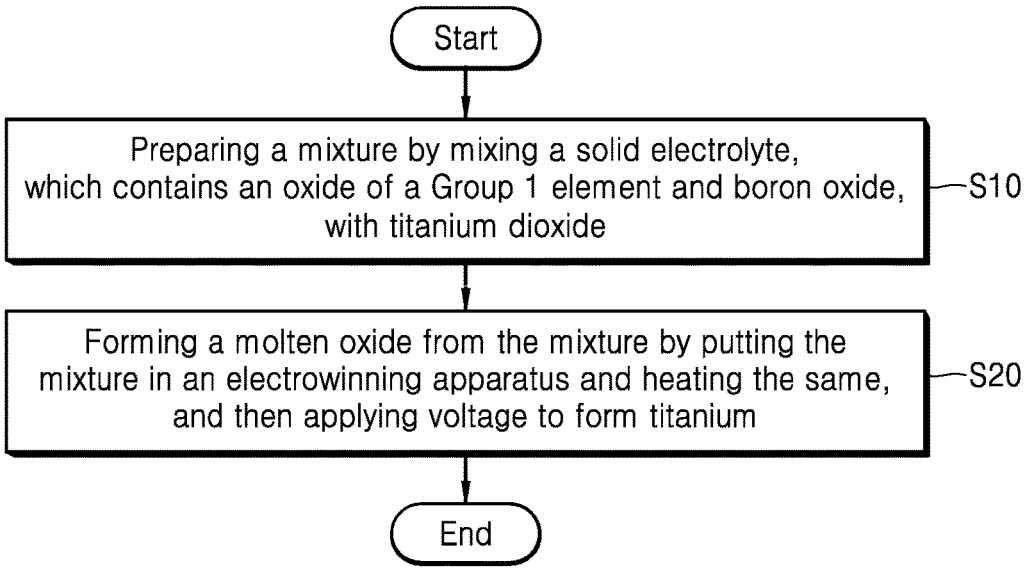

【FIG. 2】
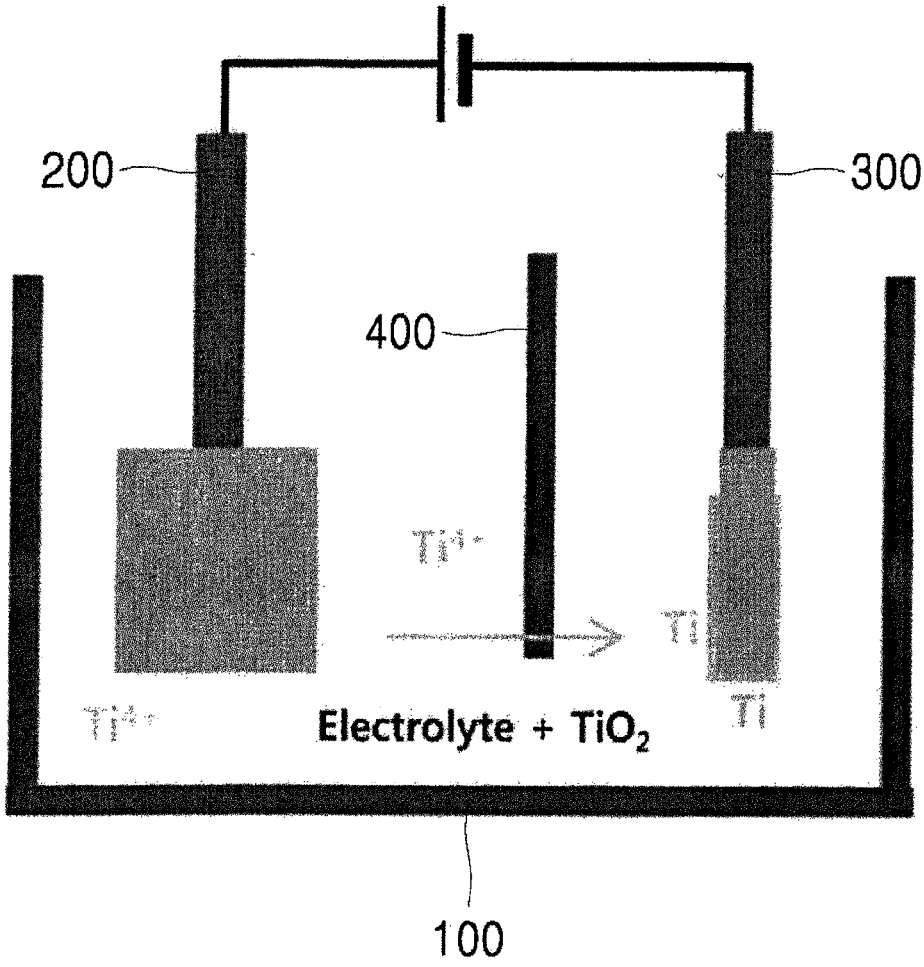

【FIG. 3】
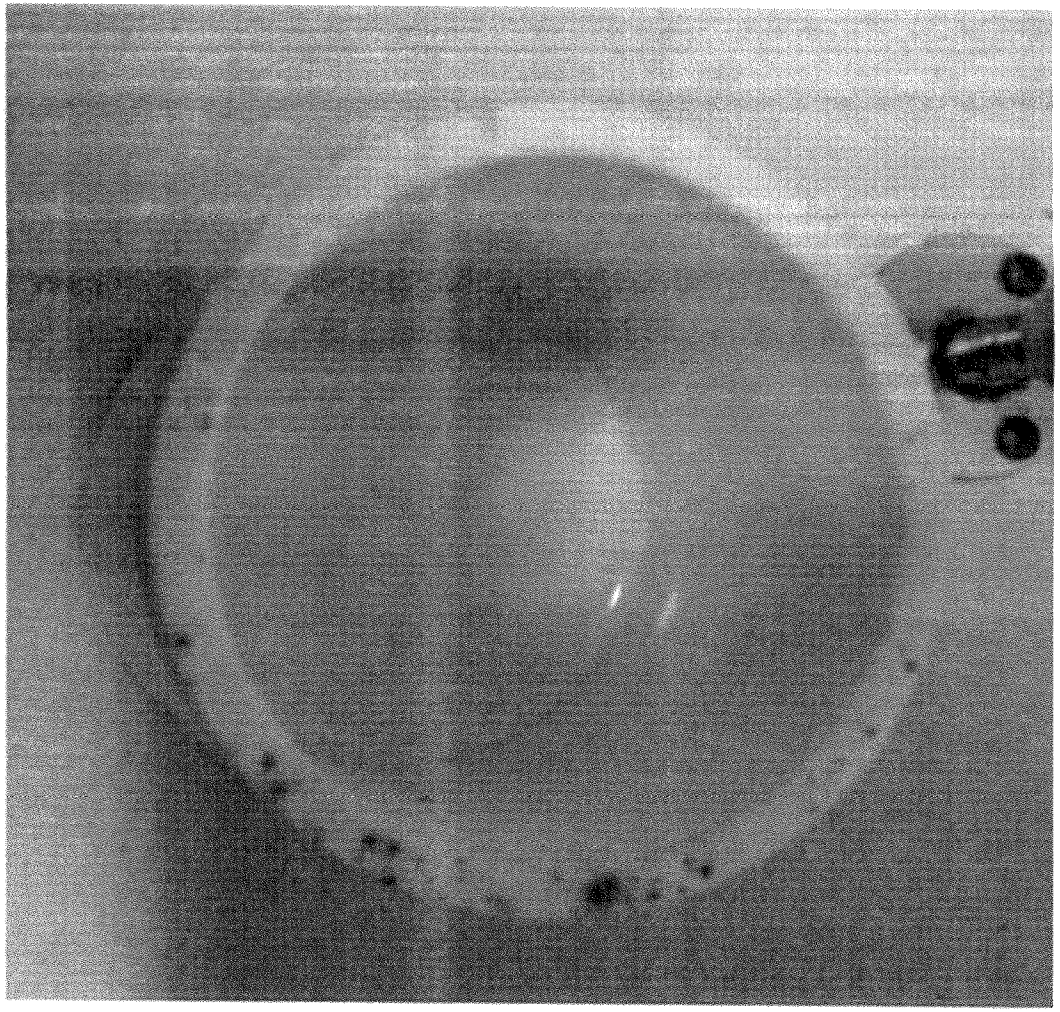

【FIG. 4】
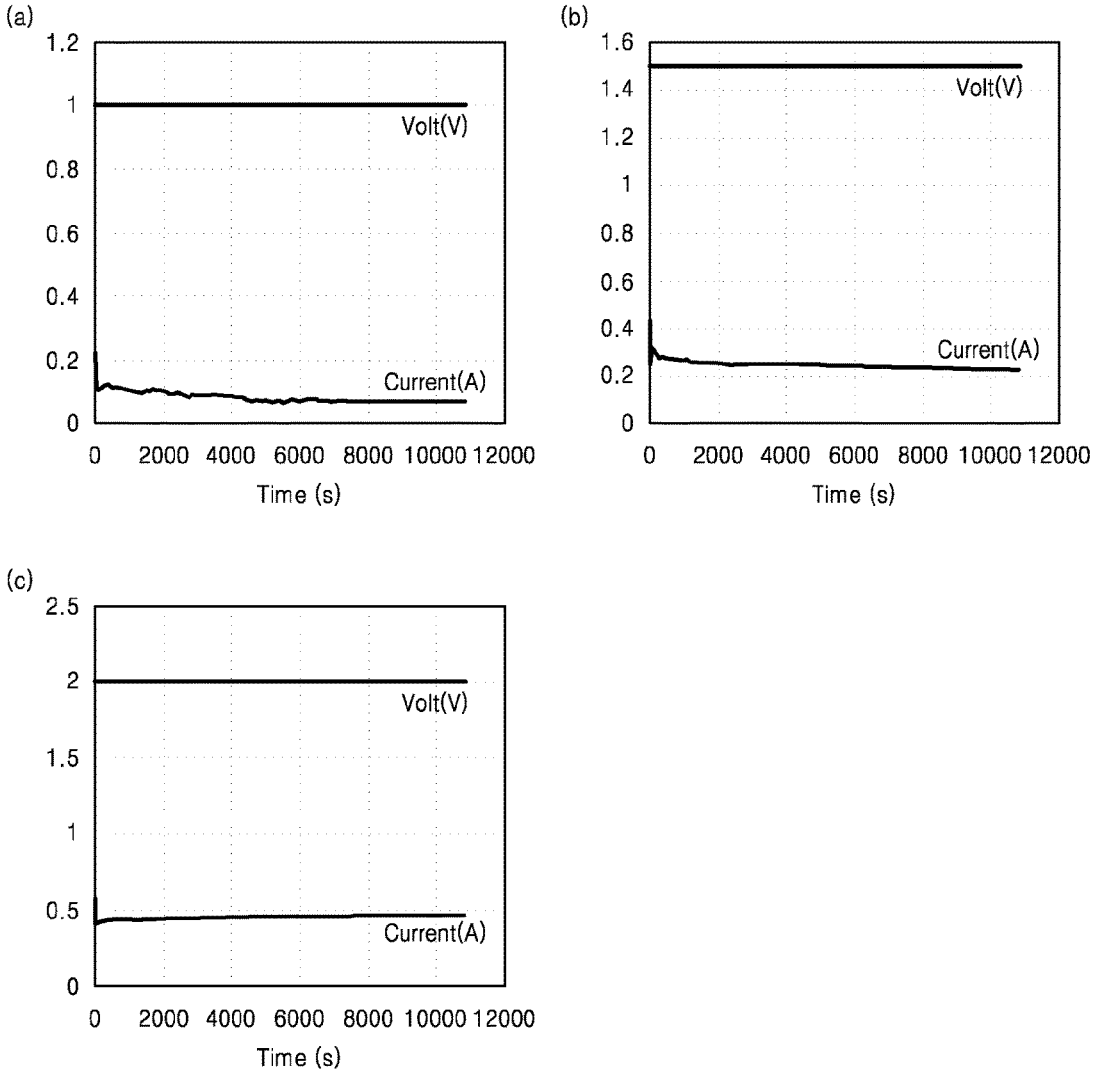

【FIG. 5】
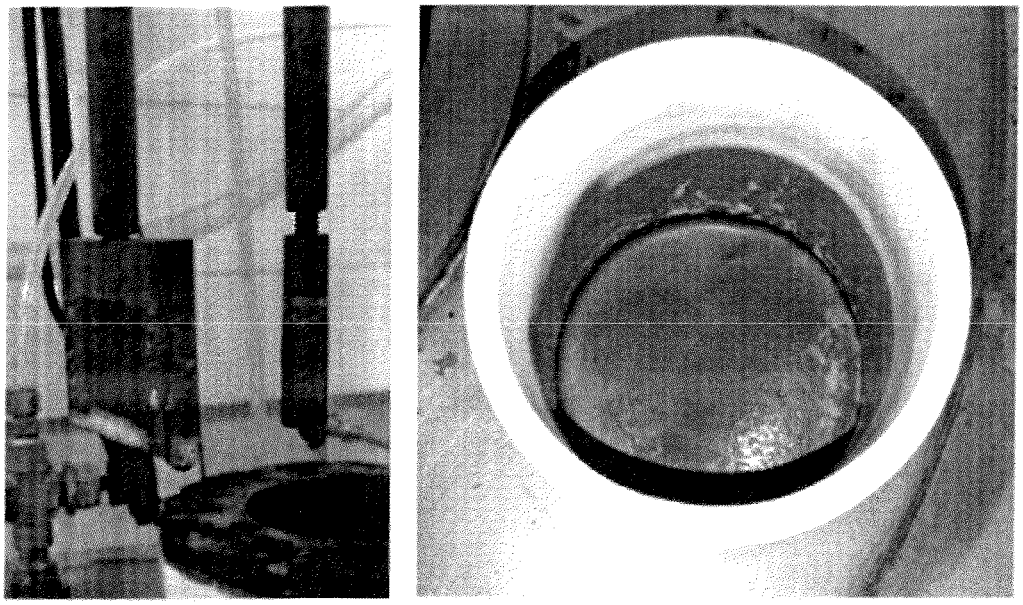
(a) (b)

【FIG. 6】
(a)
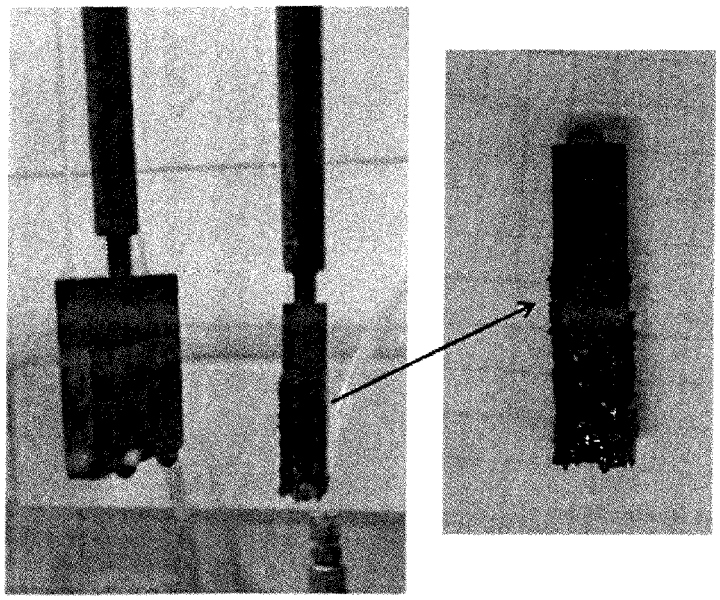
(b)
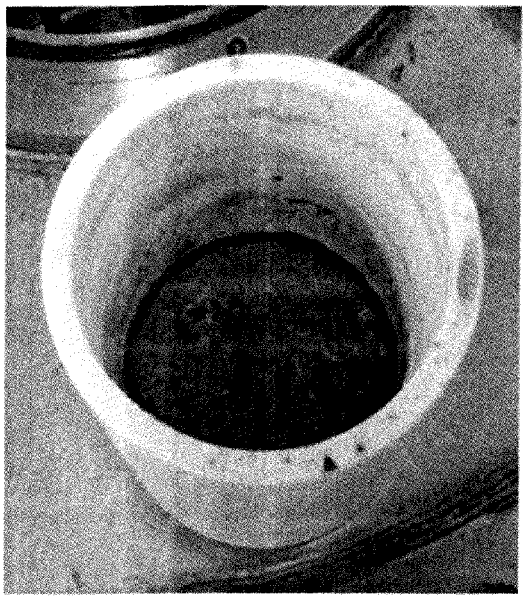

METHOD FOR PREPARING TITANIUM BY USING ELECTROWINNING

CROSS-REFERENCE TO RELATED APPLICATION(S)

This application is a U.S. National Phase Patent Application and claims priority to and the benefit of International Application Number PCT/KR2015/008062, filed on Jul. 31, 2015, which claims priority to Korean Patent Application No. 10-2014-0108369 filed on Aug. 20, 2014, the entire contents of all of which are incorporated herein by reference.

BACKGROUND OF THE INVENTION (a) Field of the Invention

The present disclosure relates to a method for preparing titanium by using electrowinning and, more particularly, to a method for preparing titanium by melting a solid electrolyte and titanium dioxide in an electrowinning apparatus comprising an anode and an insoluble cathode, and then applying voltage.

(b) Description of the Related Art

Titanium is one of the ten most abundant matters existing on Earth, is lightweight and resistant to corrosion and temperature, and is a material having strength similar to that of carbon steel and several properties of the like. 40% of titanium produced in the world is used in the aerospace industry and the rest is widely used in pipes and containers, turbine parts for offshore wind turbines, implants, surgical parts and automotive frames. However, it is difficult and costly to refine $TiO_2$-based titanium minerals, so currently, it is not more widely used than iron.

As a technique for preparing such titanium, there is the Kroll process, and specifically, $TiCl_4$ is reduced to liquid Mg at about 773 to 873° C. to prepare sponge titanium, and then distilled by vacuum distillation to remove $MgCl_2$ which is a byproduct, and a titanium center part is collected, to produce titanium. However, the Kroll process requires at least several steps of reduction, vacuum, separation, crushing and dissolution, and it has a downside of being costly.

As a related art, a titanium crystal and titanium is disclosed in Korean Patent Laid-Open Publication No. 10-2001-0020431 (published on Mar. 15, 2001).

SUMMARY OF THE INVENTION

Accordingly, the present disclosure is directed to providing a method for preparing titanium in large amounts from titanium dioxide with a simpler process and at a lower cost than the conventional Kroll method.

The problems to be solved by the present disclosure are not limited to the above-mentioned problem(s), and other problem(s) not mentioned can be clearly understood by those skilled in the art from the following description.

To solve the above-mentioned problem, an exemplary embodiment of the present disclosure provides a method for preparing titanium by using electrowinning, which may include the steps of: preparing a mixture by mixing a solid electrolyte, which contains an oxide of a Group 1 element and boron oxide, with titanium dioxide; and forming a molten oxide from the mixture by putting the mixture in an electrowinning apparatus comprising an anode and an insoluble cathode and heating the same, and then forming titanium on the cathode by applying voltage to the anode and the cathode.

At this time, the oxide of a Group 1 element may be one selected from a group consisting of $Na_2O_2$, $Na_2O$, $K_2O$ and $LiO_2$ and the boron oxide may be $B_2O_3$.

The mixture may comprise 20 to 45 weight % of the oxide of a Group 1 element, 50 to 75 weight % of boron oxide, and 5 to 30 weight % of titanium dioxide.

The insoluble cathode may be one selected from a group consisting of carbon, platinum, tantalum, and tungsten.

The heating may be performed at a temperature of 700 to 1100° C.

The voltage difference between the anode and the cathode may be 1.2 to 5.0V.

Another exemplary embodiment of the present disclosure provides a method for preparing titanium by using electrowinning, which may further include the step of recovering the titanium formed on the cathode.

The recovering may be performed by immersing the cathode in a solvent at 40 to 90° C. and then filtering the same.

As set forth above, according to the present disclosure, the process is simpler and takes shorter time than that of the Kroll method, and a large amount of titanium can be prepared from titanium dioxide.

In addition, titanium can be easily prepared just by recovering the insoluble cathode and separating the Ti, and the insoluble cathode can be reused. A continuous process is possible since the electrolyte may be reused by forming titanium using only $TiO_2$ in the solid electrolyte.

Further, the method for preparing titanium by using electrowinning according to the present disclosure uses electrowinning that uses an insoluble cathode to reduce titanium which is difficult to reduce, where $TiO_2$ is in a completely melted ion state, thereby improving the current efficiency so the production yield of titanium is high, and making it possible to minimize the production of titanium in the form of dendrite, and enabling the preparation of titanium at a low cost since the processing temperature is lower than 1100° C.

BRIEF DESCRIPTION OF THE DRAWINGS

FIG. 1 is a flowchart showing a method for preparing titanium by using electrowinning according to the present disclosure.

FIG. 2 is a schematic diagram showing an electrowinning apparatus in a method for preparing titanium by using electrowinning according to the present disclosure.

FIG. 3 is a picture showing a solid electrolyte and a molten oxide prepared by a heating process in a method for preparing titanium by using electrowinning according to the present disclosure.

FIG. 4 shows current changes according to voltage differences of a cathode and an anode in a method for preparing titanium by using electrowinning according to an exemplary embodiment of the present disclosure, wherein (a) shows the current change when the voltage difference between the cathode and the anode is 1.0V, (b) shows the current change when the voltage difference is 1.5V, and (c) shows the current change when the voltage difference is 2.0V.

FIG. 5 shows pictures of a cathode, an anode and an electrolytic cell after an electrowinning process in a method for preparing titanium by using electrowinning according to an exemplary embodiment of the present disclosure, wherein (a) is a picture showing a cathode and an anode after 3 hours of an electrowinning process at a voltage difference of 1.5V, and (b) is a picture showing an electrolytic cell.

FIG. 6 shows pictures of a cathode, an anode and an electrolytic cell after an electrowinning process in a method for preparing titanium by using electrowinning according to an exemplary embodiment of the present disclosure, wherein (a) is a picture showing the cathode and anode after 3 hours of the electrowinning process at a voltage difference of 2.0V, and (b) is a picture showing the electrolytic cell.

DETAILED DESCRIPTION OF THE EMBODIMENTS

Exemplary embodiments of the present disclosure will be described in detail below with reference to the accompanying drawings.

The present disclosure and methods of accomplishing the same may be understood more readily by reference to the following detailed description of embodiments and the accompanying drawings.

However, the present disclosure may be embodied in many different forms, and should not be construed as being limited to the embodiments set forth herein. Rather, these embodiments are provided so that this disclosure will be thorough and complete and will fully convey the concept of the disclosure to those skilled in the art, and the present disclosure will only be defined by the appended claims.

In addition, when it is determined that there is a known technology and the like in regards to describing the present disclosure which may blur the point of the present disclosure, detailed description thereof will be omitted.

The present disclosure provides a method for preparing titanium by using electrowinning, including the steps of: preparing a mixture by mixing a solid electrolyte, which contains an oxide of a Group 1 element and boron oxide, with titanium dioxide; and forming a molten oxide from the mixture by putting the mixture in an electrowinning apparatus comprising an anode and an insoluble cathode and heating the same, and then forming titanium on the cathode by applying voltage to the anode and the cathode.

The method of preparing titanium using electrowinning according to the present disclosure has a simpler process and takes shorter process time than that of the Kroll method, and a large amount of titanium can be prepared, and a continuous process is possible since the anode, cathode, and electrolyte can be reused. Also, it is advantageous in that, although relatively stable metals such as Cu, Zn, Ni, Co, Cr, Mn and the like can be electrolyzed using aqueous solutions, it is even possible to completely melt hardly reducible matters such as Ti and use a method of electrowinning in an ion state to reduce it. Further, the current efficiency is improved so the production yield of titanium can be improved, and the titanium is prepared by solid electrolyte being formed into a molten oxide at 1100° C. or less, thereby the overall processing cost is lower than that of the conventional Kroll method.

FIG. 1 is a flowchart showing a method for preparing titanium using electrowinning according to the present disclosure. Hereinafter, the present disclosure will be described in detail with reference to FIG. 1.

The method for preparing titanium by using electrowinning according to the present disclosure includes preparing a mixture by mixing a solid electrolyte which contains an oxide of a Group 1 element and boron oxide, with titanium dioxide at step S10.

AS the oxide of a Group 1 element, one selected from a group essentially consisting of $Na_2O_2$, $Na_2O$, $K_2O$ and $LiO_2$ may be used, and as the boron oxide, $B_2O_3$ may be used.

At this time, the oxide of a Group 1 element, the boron oxide, and titanium dioxide may be stirred and mixed by at least one selected from a group consisting of a ball mill, attrition mill, vibration mill, jet mill, and wet ultrasonic waves.

It is preferable for the mixture to include 20 to 45 weight % of the oxide of a Group 1 element, 50 to 75 weight % of the boron oxide, and 5 to 30 weight % of the titanium dioxide. When titanium dioxide is less than 5 weight %, there is problem of the production yield of titanium being low, and when it exceeds 30 weight %, there is a problem of molten oxide not forming in the temperature range of 700 to 1100° C. Further, when the boron oxide in the solid electrolyte including the oxide of a Group 1 element and the boron oxide is less than 50 weight %, there is the problem of the heating temperature exceeding 1100° C., and when it exceeds 75 weight %, there is a problem of the content of titanium decreasing and lowering the yield thereof. As described above in the method for preparing titanium using electrowinning, since the solid electrolyte includes an oxide of a Group 1 element and a boron oxide, due to the boron oxide which is a main material of the solid electrolyte, titanium can be prepared even at a low current in the reduction reaction, and rather than using a carbonate material such as $Na_2CO_3$, by using an oxide of a Group 1 element, the problem of the purity of titanium being lowered due to a carbonate is prevented, and it is possible to smoothly produce molten oxide during the heating process, and high purity titanium can be prepared. Further, in the mixed solid electrolyte of $Na_2CO_3$ and $B_2O_3$, titanium is not formed.

The method for preparing titanium using electrowinning may further include the steps of sieving and weighing the mixture after the mixture is prepared.

The mixture mixed in the stirring step is sieved in a sieve having a specific mesh size of 1.0 mm, and the mixture having a powder size of 1.5 to 2.0 cm is weighed to 250 to 300 g so that the molten oxide can be formed smoothly during the subsequent heating process. At this time, when the size of the electrolytic cell is increased, a greater weight of the mixture, more than the above-mentioned mixture, may be provided in the electrolytic cell to prepare titanium in large amount.

In addition, the method for preparing titanium using electrowinning may further include the step of pre-sintering the mixture after the mixture is prepared, and by performing the pre-sintering step, the mixture of the oxide of a Group 1 element, boron oxide, and titanium dioxide can be formed smoothly into a molten oxide.

Next, the method for preparing titanium using electrowinning according to the present disclosure includes forming a molten oxide from the mixture by putting the mixture in an electrowinning apparatus comprising an anode and an insoluble cathode and heating the same, and then forming titanium on the cathode by applying voltage to the anode and the cathode at step S20.

The method for preparing titanium using electrowinning according to the present disclosure may be performed using an electrowinning apparatus as shown in FIG. 2. The electrowinning apparatus includes an electrolytic cell 100 provided with a solid electrolyte and a mixture of titanium dioxide, and an anode 200 and cathode 300 to which voltage is applied, and additionally includes a cation exchange membrane 400 which is an insulator between the anode and cathode, so the cation ($Ti^{4+}$) may move smoothly to the cathode. After applying voltage, titanium is formed at the cathode 300 of the electrowinning apparatus. The cathode is insoluble and one selected from a group consisting of carbon, platinum, tantalum, and tungsten may be used, and for the electrolytic cell, one made of alumina ($Al_2O_3$) material may be used.

Preferably, the heating is performed at 700 to 1100° C., and specifically, it is preferable that the heating is maintained for 3 hours after being heated to 700 to 1100° C. at a heating rate of 3° C./min. When the heating is less than 700° C., there is the problem of the solid electrolyte not being completely melted and the yield of titanium being low in the subsequent electrowinning process, and when the heating exceeds 1100° C., platinum has to be used as the cathode and anode and there is the problem of the process cost being increased due to the high temperature.

Further, it is preferable for the voltage difference between the anode and cathode to be 1.2V or more, and more preferable to be 1.2 to 5.0V. This is because titanium is formed at 1.2V or more, and as the size of the electrolytic cell increases, the voltage difference may increase, but when exceeding 5.0V, a large amount of titanium is prepared in the form of dendrite, and titanium of high purity may not be prepared due to a large amount of impurities such as boron produced in the titanium.

In addition, the method for preparing titanium using electrowinning according to the present disclosure may further include the step of recovering the titanium formed on the cathode.

The recovering may be performed by immersing the cathode in a solvent at 40 to 90° C. and then filtering the same. When the cathode is immersed in the solvent, the titanium formed at the cathode is separated from the cathode to dissolve in the solvent, and the dissolved titanium may be recovered by a filtration process using a filter paper. The solvent may be at least one selected from a group consisting of deionzed water and heavy water. Moisture is present on the recovered titanium, so it may be dried in an oven.

EXAMPLE 1

Preparation of Titanium Using Electrowinning 1

A solid electrolyte containing $Na_2O_2$ which is a Group 1 element oxide and boron oxide ($B_2O_3$) was mixed with titanium dioxide ($TiO_2$) by a ball mill to prepare a mixture. At this time, the $Na_2O_2$, $B_2O_3$, and $TiO_2$ were mixed by 20 weight %, 73 weight %, and 7 weight % of the total mixture weight, respectively. The prepared mixture was put inside are electrowinning apparatus and heated to 1000° C. to make the mixture into a molten oxide, and then voltage was applied for three hours to the anode and cathode of the electrowinning apparatus so that the voltage difference was 1.2 to 5.0V. The $Ti^{4+}$ ion present in the molten oxide moved to the cathode to receive an electron from the surface of the cathode, being reduced to Ti. The cathode with the Ti formed may be scratched for the recovering, but in order to effectively recover the Ti, it was immersed two to three times in deionized water of 80° C. to separate the Ti from the cathode. The Ti dissolved in the deionized water was recovered by filtration using a filter paper, and to remove the deionized water remaining on the recovered Ti, it was dried for a day in an oven of 50° C., and Ti powder was recovered.

EXAMPLE 2

Preparation of Titanium Using Electrowinning 2

Other than sieving the mixture of the solid electrolyte and titanium dioxide with a 1.00 mm sized sieve and then weighing it to 250 to 300 g while having a powder size of 1.5 to 2.0 cm, the titanium was prepared in the same manner as the above Example 1.

EXAMPLE 3

Preparation of Titanium Using Electrowinning 3

Other than pre-sintering the mixture weighed in Example 2 at 1000° C. and then providing it to the electrowinning apparatus, the titanium was prepared in the same manner as the above Example 1.

EXPERIMENTAL EXAMPLE 1

Analysis of Molten Oxide

The molten oxide of the solid electrolyte and titanium dioxide prepared by the heating process in the method for preparing titanium using electrowinning according to the present disclosure was analyzed, and the results are shown in FIG. 3.

As shown in FIG. 3, it can be seen that the mixture of Example 1 was formed into a translucent molten oxide by the heating process and even after cooling, the solid electrolyte was well melted. It was confirmed that titanium leaching is also smoothly carried out when titanium is leached afterwards.

EXPERIMENTAL EXAMPLE 2

Analysis of Current Change According to Voltage in the Electrowinning Process The change in current when a voltage is applied to the cathode and anode of the method for preparing titanium using electrowinning according to the present disclosure was observed and the results are shown in FIG. 4. FIG. 4(*a*) shows the current change when a voltage difference between a cathode and an anode is 1.1V in a method for preparing titanium by using electrowinning according to the present disclosure, FIG. 4(*b*) shows the current change when the voltage difference is 1.5V, and FIG. 4(*c*) shows the current change when the voltage difference is 2.0V.

As shown in FIG. 4, the voltage slightly increased with time only at a voltage difference of 2V. It can be seen that the reduction reaction continues to be maintained due to the high voltage difference. Further, when the voltage difference is 1.5V, if titanium is formed after the reduction reaction, the reduction reaction is no longer maintained, so it can be seen that the current gradually decreases with time. On the other hand, when the voltage difference is 1.1V, the reduction reaction does not occur, so it can be seen that the current gradually decreases with time. Therefore, it can be seen that as the voltage difference increases, the current increases slightly, and the reduction reaction is considered to occur at about 0.3 A or more.

EXPERIMENTAL EXAMPLE 3

Analysis of the State of the Cathode, Anode and Electrolytic Cell After the Electrowinning Process The state of the cathode, anode and electrolytic cell after the electrowinning process in the method for preparing titanium using electrowinning according to the present disclosure was analyzed, and the results are shown in FIGS. 5 and 6.

FIG. 5(*a*) is a picture showing a cathode and anode after 3 hours of an electrowinning process at a voltage difference of 1.5V, and FIG. 5(*b*) is a picture showing an electrolytic cell.

As shown in FIG. 5(*a*), it can be seen that titanium was formed since the lower end of the cathode became slightly thicker and a reduction reaction occurred. At this time, the weight of the cathode slightly increased from 5.08 g to 5.75 g.

FIG. 6(*a*) is a picture showing a cathode and anode after 3 hours of an electrowinning process at a voltage difference of 2.0V, and FIG. 6(*b*) is a picture showing an electrolytic cell.

As shown in FIG. 6(*a*), it can be seen that titanium was formed on the cathode through the reduction reaction of the electrowinning process. At this time, the weight of the cathode increased from 5.12 g to 5.94 g.

As shown in FIGS. 5(*a*) and 6(*a*), it can be seen that as the voltage difference increases, the weight of the cathode increases, and the production of titanium increases.

While this invention has been described in connection with what is presently considered to be practical exemplary embodiments of a method for preparing titanium using electrowinning according to the present disclosure, it is to be understood that the invention is intended to cover various modifications included within the spirit and scope of the appended claims.

Accordingly, it is to be understood that the invention is not limited to the disclosed embodiments, and the scope of the present disclosure shall be determined by not only the attached claims, but also the equivalent arrangements included within the spirit of the appended claims.

That is, it is to be understood that the above-described embodiments are illustrative in all aspects and should not be construed as limiting, and the scope of the present invention is indicated by the appended claims rather than the foregoing description, and all changes or modifications that come within the spirit and scope of the invention are to be construed as being included within the scope of the present invention.

What is claimed is:

1. A method for preparing titanium by using electrowinning, comprising the steps of: preparing a mixture by mixing a solid electrolyte, which contains an oxide of a Group 1 element and boron oxide, with titanium dioxide; and forming a molten oxide from the mixture by putting the mixture in an electrowinning apparatus comprising an anode and an insoluble cathode and heating the same, and then forming titanium on the cathode by applying voltage to the anode and the cathode, wherein the voltage difference between the anode and the cathode is maintained at 2 V and a current increases slightly during the forming the titanium on the cathode.

2. The method of claim 1, wherein the oxide of a Group 1 element is one selected from a group consisting of $Na_2O_2$, $Na_2O$, $K_2O$ and $LiO_2$.

3. The method of claim 1, wherein the boron oxide is $B_2O_3$.

4. The method of claim 1, wherein the mixture comprises 20 to 45 weight % of the oxide of a Group 1 element, 50 to 75 weight % of the boron oxide, and 5 to 30 weight % of the titanium dioxide.

5. The method of claim 1, wherein the insoluble cathode is one selected from a group consisting of carbon, platinum, tantalum, and tungsten.

6. The method of claim 1, wherein the heating is performed at a temperature of 700 to 1100° C.

7. The method of claim 1, further comprising the step of recovering the titanium formed on the cathode.

8. The method of claim 7, wherein the recovering is performed by immersing the cathode in a solvent at 40 to 90° C. and then filtering the same.

* * * * *